US010510271B2

(12) United States Patent
Quintin

(10) Patent No.: US 10,510,271 B2
(45) Date of Patent: Dec. 17, 2019

(54) LABEL FOR DECORATING A BOTTLE, BOTTLE AND METHOD OF MANUFACTURE OF SUCH A LABEL

(71) Applicant: CEVENPACK, Saint-Hyppolyte du Fort (FR)

(72) Inventor: Jean-David Quintin, Saint Hyppolyte du Fort (FR)

(73) Assignee: CEVENPACK, Saint-Hyppolyte du (FR)

( * ) Notice: Subject to any disclaimer, the term of this patent is extended or adjusted under 35 U.S.C. 154(b) by 111 days.

(21) Appl. No.: 15/911,088

(22) Filed: Mar. 3, 2018

(65) Prior Publication Data

US 2018/0190157 A1 Jul. 5, 2018

Related U.S. Application Data

(63) Continuation-in-part of application No. 15/031,143, filed as application No. PCT/FR2014/052721 on Oct. 24, 2014, now Pat. No. 9,934,703.

(30) Foreign Application Priority Data

Oct. 24, 2013 (FR) ..... 13 60410

(51) Int. Cl.

| | |
|---|---|
| ***G09F 3/10*** | (2006.01) |
| ***G09F 3/02*** | (2006.01) |
| ***B65D 23/14*** | (2006.01) |
| ***B44C 3/02*** | (2006.01) |
| *B44C 1/10* | (2006.01) |

(52) U.S. Cl.

CPC ..... *G09F 3/02* (2013.01); *B44C 3/025* (2013.01); *B65D 23/14* (2013.01); *G09F 3/10* (2013.01); *B44C 1/105* (2013.01); *G09F 2003/023* (2013.01); *G09F 2003/0261* (2013.01); *G09F 2003/0273* (2013.01)

(58) Field of Classification Search

CPC ..... G09F 3/10; G09F 3/02; G09F 2003/0272; Y10T 428/14; Y10T 428/1476

See application file for complete search history.

(56) References Cited

U.S. PATENT DOCUMENTS

| | | | | |
|---|---|---|---|---|
| 3,869,285 A * | 3/1975 | Kondo | B41N 1/003 | 430/49.2 |
| 3,890,449 A * | 6/1975 | Mezquita | B44C 5/00 | 426/127 |
| 5,512,122 A * | 4/1996 | Sokyrka | B41M 3/16 | 156/275.5 |
| 5,857,275 A * | 1/1999 | Deal | G09F 3/02 | 40/310 |

(Continued)

*Primary Examiner* — Shin H Kim

(74) *Attorney, Agent, or Firm* — Patshegen IP LLC; Moshe Pinchas

(57) ABSTRACT

The self-adhesive label is produced in relief in order to visually and/or tactilely simulate a decorative molding of a material of a container or a decorative seal or stamp applied to the container.

The self-adhesive label comprises, successively:

a layer of adhesive,
a flexible plastic sheet,
an undercoat varnish on the flexible plastic sheet, and
an overcoat varnish on the undercoat varnish.

The undercoat varnish and the overcoat varnish are configured to repel each other, so that the overcoat varnish is retracted into the shape of a drop.

19 Claims, 12 Drawing Sheets

(56) References Cited

U.S. PATENT DOCUMENTS 5,982,284 A * 11/1999 Baldwin ..... G06K 19/0672 29/829
6,270,871 B1 * 8/2001 Scholz ..... G09F 3/10 428/40.1
6,760,989 B2 * 7/2004 Peterson ..... G09F 7/00 40/593
6,857,211 B2 * 2/2005 Grasso ..... G09F 3/02 40/310
7,185,453 B2 * 3/2007 Spear ..... G09F 3/02 40/616
8,302,337 B2 * 11/2012 Savagian ..... B32B 7/06 40/615
10,252,561 B2 * 4/2019 Richert ..... B41M 3/14
2002/0081400 A1 * 6/2002 Gocho ..... B41M 3/14 428/29
2003/0150148 A1 * 8/2003 Spear ..... G09F 3/02 40/638
2003/0221347 A1 * 12/2003 Peterson ..... G09F 7/00 40/593
2004/0111941 A1 * 6/2004 Spear ..... G09F 3/02 40/638
2005/0160637 A1 * 7/2005 Hesse ..... E04H 13/003 40/124.5
2011/0296727 A1 * 12/2011 Savagian ..... B32B 7/06 40/594
2014/0163664 A1 * 6/2014 Goldsmith ..... A61B 17/00491 623/1.11
2015/0279245 A1 * 10/2015 Siekkinen ..... B32B 27/08 40/638
2016/0101642 A1 * 4/2016 Richert ..... B41M 3/14
2018/0154678 A1 * 6/2018 Olszowka ..... B42D 25/41
2019/0001735 A1 * 1/2019 Cathomen ..... B42D 25/455

* cited by examiner

LABEL FOR DECORATING A BOTTLE, BOTTLE AND METHOD OF MANUFACTURE OF SUCH A LABEL

TECHNICAL FIELD OF THE INVENTION

The present invention envisages a label for decorating a bottle, bottle and method of manufacture of such a label. It applies to enhancing a packaging, e.g. a perfume bottle, or a glass bottle, notably for drinks and in particular for wine or spirits.

STATE OF THE ART

Glass moldings and engravings for bottles are known that make it possible to incorporate a customization in 3D within the wall of these bottles. However, these moldings or engravings are costly and can cause mechanical weaknesses in certain areas of the bottle.

Wax seals are also known, which are placed on bottles to give them a more elegant look. However, these seals are costly to manufacture, hard to replicate and affix on the bottles.

Document DE9317987 is known, which describes a paper label having a thickened edge to protect its surface from wear. However, this type of label does not look to be made from the same material as the bottle and therefore does not enhance the bottle.

Document WO 98/33660 is known, which describes a label with a pseudo-3D display thanks to optical lenses or a hologram. However, this type of label does not look to be made from the same material as the bottle and therefore does not enhance the bottle.

Document DE 42 14 294 is known, which describes a label fitted with an insert for protection from shocks. However, this type of label does not look to be made from a single material and even less from the same material as the bottle, and therefore does not enhance the bottle.

The screen printing of 3D varnishes cured with ultraviolet ("UV") rays is known, for obtaining a text in braille, a tactile triangle or for emphasizing a design on packaging for luxury products. The thickness of these varnishes is generally obtained with a single 100- to 150-micron layer of varnish. The chemical formulations of these varnishes contain, among others, silicone-based surfactants and photoinitiators that are reactive to ultraviolet rays. With these additives, the 3D varnishes generally appear milky, cloudy and whitish in light. They turn yellow after polymerization under ultraviolet rays, and become rigid and break after a few days, which encourages a lack of adhesion on some semi-rigid synthetic mounting surfaces and poor mechanical resistance to stretching.

For our decorative label aimed at simulating the customization of a glass bottle by glass molding, the relief of the pattern requires a thickness two to three times greater than that of a standard 3D print described above. In addition, the label must be as transparent as possible, so that the overall appearance of the label is similar to the reliefs of an actual glassmaker's molding of the bottle. The label, and therefore each varnish, must be relatively flexible, so as to be compatible with the flexibility of the adhesive carrier on which it is printed, facilitate the label's application on a glass bottle with cylindrical, curved or irregular shapes, and avoid retraction phenomena after application.

SUBJECT OF THE INVENTION

The present invention aims to remedy all or part of these drawbacks.

To this end, according to a first aspect, the present invention envisages a self-adhesive label produced in relief in order to visually and/or tactilely simulate a decorative molding of a material of a container or a decorative seal or stamp applied to the container, the self-adhesive label comprising, successively:

a layer of adhesive, a flexible plastic sheet, an undercoat varnish on the flexible plastic sheet, and an overcoat varnish on the undercoat varnish, wherein the undercoat varnish and the overcoat varnish are configured to repel each other, so that the overcoat varnish is retracted into the shape of a drop.

Thanks to these features, the label exhibits a relief that is better than all the other printing techniques known to the person skilled in the field, the relief having a "water drop" effect or "doming effect".

Moreover, the label exhibits a perfect surface appearance: the retraction of the varnish on itself results in a uniform surface finish, smooth on the surface, very glossy and rounded, which captures the light reflections. This appearance is comparable to the reliefs of molded patterns that customize glass bottles.

In embodiments, the undercoat varnish and the overcoat varnish are immiscible varnishes.

In embodiments, the spreading coefficient of the liquid overcoat varnish on the polymerized undercoat varnish is a negative value In embodiments, the undercoat varnish and/or the overcoat varnish is polymerized under ultraviolet rays.

In embodiments, the undercoat varnish is formulated with surfactants on a polyurethane base.

In embodiments, the undercoat varnish includes silicone.

In embodiments, the overcoat varnish is formulated on an acrylic/polyurethane base.

In embodiments, the overcoat varnish is "silicone free", i.e., formulated without siliconized surfactant.

In embodiments:

the flexible plastic sheet has a cut edge at a periphery of the flexible plastic sheet, one face of the flexible plastic sheet being entirely covered by the layer of adhesive; and an extra thickness comprising the undercoat varnish and the overcoat varnish is formed on a surface of the flexible plastic sheet opposite the layer of adhesive, the extra thickness having an uppermost first surface and a lowermost second surface in contact with the flexible plastic sheet, and being comprised of a flexible plastic material from the uppermost first surface to the lowermost second surface, the lowermost second surface of the extra thickness being in contact with and covering the upper second face of the flexible plastic sheet at the cut edge of the flexible plastic sheet, the extra thickness, from the uppermost first surface to the lowermost second surface, forming a decorative design simulating an engraved relief or an edge of a seal, the extra thickness having a cut edge extending from i) a periphery of the lowermost second surface of the extra thickness to ii) a periphery of the uppermost first surface of the extra thickness, wherein the cut edge at the periphery of the extra thickness and the cut edge at the periphery of the flexible plastic sheet are cut jointly, the cut edge at the periphery of the lowermost second surface of the extra thickness coinciding with the cut edge of the flexible plastic sheet as a continuation of the cut edge of the flexible plastic sheet up to the lower surface of the flexible plastic sheet.

Thanks to these provisions, the extra thickness of plastic material hides the edge of the plastic sheet and therefore prevents:

- any means of detecting that the label is made of several layers;
- any means of detecting that the label is affixed by gluing onto the container;
- any reflection that would make it possible to detect, by eye, that this is a label rather than a glass molding, an engraving in the glass or a wax seal; and
- any overspill of the extra thickness or of the sheet that would make it possible to detect, by touch, that this is a label rather than a glass molding, an engraving in the glass or a wax seal.

Once glued, the label gives the impression of being incorporated into the material of the carrier, e.g. a bottle, or of forming a wax seal placed by melting wax.

The extra thickness that follows the outline of the label creates an esthetic barrier and has three functions:

- making the label's edges invisible once the label has been pressed up against the glass of a bottle;
- partitioning two different materials, firstly the bottle's glass and secondly the synthetic material of the label, to prevent the consumer from detecting their different aspect and brightness; and
- strengthening the label against tears or plastic deformations.

The label that is the subject of the present invention is easy to affix by hand or using a standard labeler. Utilizing it makes it possible to customize small, medium and large quantities of bottles at a low cost, while avoiding the constraints of glassmakers, such as capital investment for the mold, a large minimum quantity, required storage, blocked funds and engraving on glass, with the mechanical weaknesses it causes.

The label that is the subject of the present invention thus has a relief similar to that produced with a glassmaker's molding or by melting a wax seal.

In embodiments, the layer of adhesive, the flexible plastic sheet the undercoat varnish and the overcoat varnish are, at least in part, transparent.

The label thus looks as if it is made of the glass of the bottle that bears it.

In embodiments, at least one of the varnishes comprises digital printing with a UV varnish.

For example, this printing is produced thanks to a UV varnish, with or without a tinted undercoat. Thanks to these provisions, small and medium-size runs of labels can be handled and tooling costs sharply reduced. For labels designed to customize clear glass bottles, during the application by inkjet of the varnish in 3D, a complete absence of air bubbles is noted, giving at the end a completely translucent varnish, unlike a screen-printed varnish that may become laden with bubbles and lose its transparency.

In embodiments, the flexible plastic sheet bears a "resin stop" molding printed with an aqueous or UV varnish configured to repel at least one of the undercoat varnish and the overcoat varnish.

In embodiments, the flexible plastic sheet comprises metallized polyester.

Thanks to each of these provisions, the forming of a metallized design, gold- or silver-colored for example, is achieved in a label resembling a wax seal, thanks to the solid area of ink, thanks to the appearance of the metallized polyester visible in the margins.

In embodiments, the flexible plastic sheet is made of PVC, PP or transparent polyolefin.

In embodiments, the flexible plastic sheet carries printing of two screen-printed solid areas of matte ink, superimposed on each other forming a totally opaque color background.

The advantages of the label utilizing these last embodiments comprise, compared to a conventional wax seal:

- this label eliminates the painstaking set up for a genuine "wax seal", where the wax has to be softened, poured onto the object, the wax stamped and engraved with a more or less successful rendering, all with very low yields;
- this label can be delivered on backing sheets, be removed from the carrier and be glued by hand onto its new carrier, as easily and quickly as a self-adhesive sticker;
- this operation can be carried out in hidden time, since it requires no implementation and no particular know-how to achieve an appearance with a constant level of quality;
- this label adopts geometrically involute shapes, unlike a wax seal;
- this label is made from materials that are highly flexible, highly resistant to hot and cold temperature differences, that meet industrial specifications, unlike "wax seals", which are fragile, breakable, deformable, can deteriorate and are sensitive to heat;
- this label can be produced in all colors, with no colorimetric limitations, and its shape is scalable; and
- this label can be manufactured in large series to meet large requirements, e.g. for forty thousand labels per day.

According to a second aspect, the present invention envisages a bottle made of glass bearing a label according to the present invention as defined above glued on its surface, wherein the undercoat varnish and/or the overcoat varnish comprises pigments of the color of the glass of which the bottle is made.

The label that is the subject of the present invention can thus be tinted in the same color as the glass of the bottle to which it is intended to be glued. It is recalled that, in the meaning of the present invention, the term "bottle" encompasses not only bottles and flasks, but more generally, any rigid container that can contain a product.

According to a third aspect, the present invention envisages a method of manufacturing a self-adhesive label produced in relief in order to visually and/or tactilely simulate a decorative molding of a material of a container or a decorative seal or stamp applied to the container, the method comprising:

a step of applying adhesive onto a first surface of a flexible plastic sheet, the flexible plastic sheet having a second surface opposite the first surface;

a step of applying, on the second surface of the flexible plastic sheet, an undercoat varnish; and a step of applying, on the undercoat varnish, an overcoat varnish, wherein the undercoat varnish and the overcoat varnish are configured to repel each other, so that the overcoat varnish is retracted into the shape of a drop.

As the particular features, advantages and aims of this bottle and of this method that are the subjects of the present invention are similar to those of the label that is the subject of the present invention, they are not repeated here.

Thus, by forming a magnifier, the upper and side portion leaves exactly the same color visible over the whole surface of the upper and side portion as the lower portion it covers. To the inventor's knowledge, it is impossible to obtain embossing of this quality either in terms of height or look by any other method.

In embodiments, the method further comprises a step of jointly cutting i) a periphery of the undercoat varnish, ii) a periphery of the overcoat varnish and iii) a periphery of the flexible plastic sheet to thereby form a cut edge in the extra thickness comprising the undercoat varnish and the overcoat varnish and in the flexible plastic sheet, so that the cut edge of the extra thickness is formed as a continuation of the cut edge of the flexible plastic sheet up to a lower surface of the flexible plastic sheet.

In embodiments, the method further comprises:

a step of printing a molding with a side varnish configured to repel the undercoat varnish;

a step of half-cutting the shape of the label so as to cut only the thickness of the sheet and not that of the removable carrier;

a step during which undercoat varnish is poured outside the side varnish, the undercoat varnish stopping when it abuts the cut; and a step of hardening the undercoat varnish.

Thanks to each of these provisions, the extra thickness takes the shape of a drop of thick liquid, as does a wax or glass seal deposited by melting.

The invention also provides:

exceptional adhesion, thanks to the naturally sticky polyurethane undercoat. Its excellent adhesive power on all synthetic surfaces serves as interface between the 3D varnish and the adhesive carrier;

great flexibility of the entire label: thanks to its very flexible undercoat, which acts as shock mount, the label can be stretched more than 20%; and an ability of the label to be fixed with pressure, which makes it possible to remove the bubbles between the label and the mounting surface, for example the glass of a bottle, thereby preventing the appearance of unsightly bubbles that would make the simulation of glass molding futile.

BRIEF DESCRIPTION OF THE FIGURES

Other particular advantages, aims and features of the invention will become apparent from the non-limiting description that follows of at least one particular embodiment of the label, bottle and method for manufacturing such a label, with reference to drawings included in an appendix, wherein.

DESCRIPTION OF EXAMPLES OF REALIZATION OF THE INVENTION

It is now noted that FIGS. 1-4 are not to scale.

Figure 1:
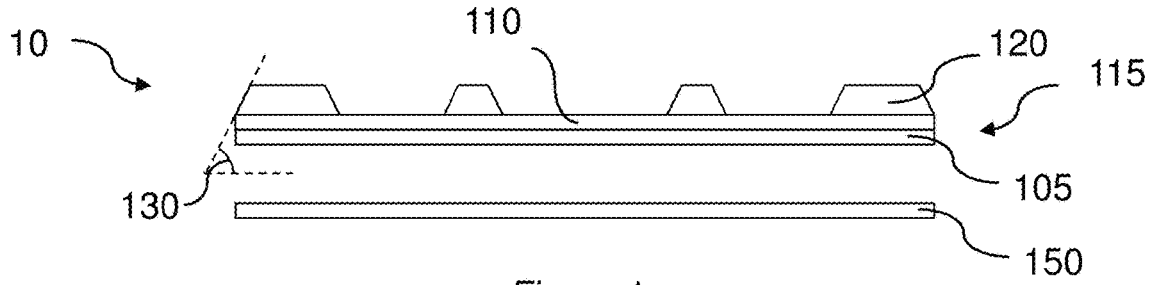
FIG. 1 represents, schematically and in cross section, a first particular embodiment of the label that is the subject of the present invention.
Figure 2:
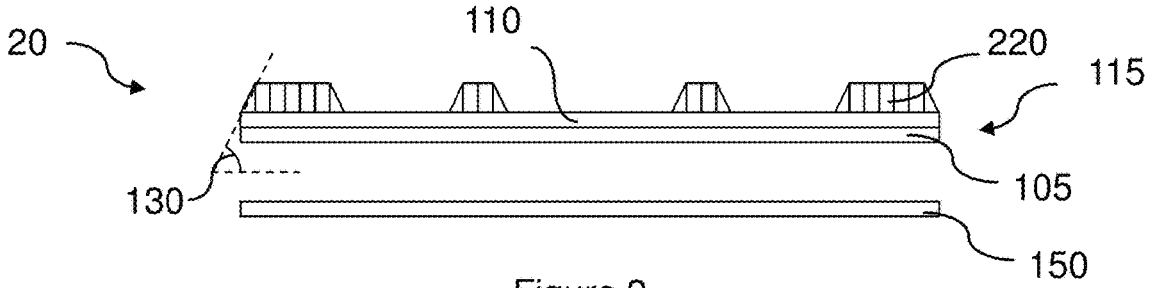
FIG. 2 represents, schematically and in cross section, a second particular embodiment of the label that is the subject of the present invention.
Figure 3A:
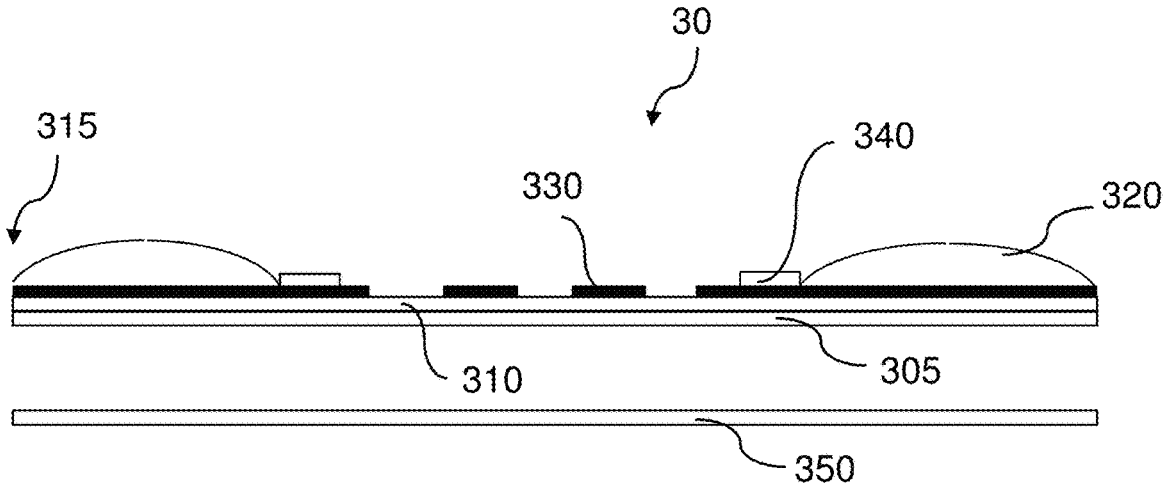
FIG. 3A represents, schematically and in cross section, a third particular embodiment of the label that is the subject of the present invention.
Figure 3B:
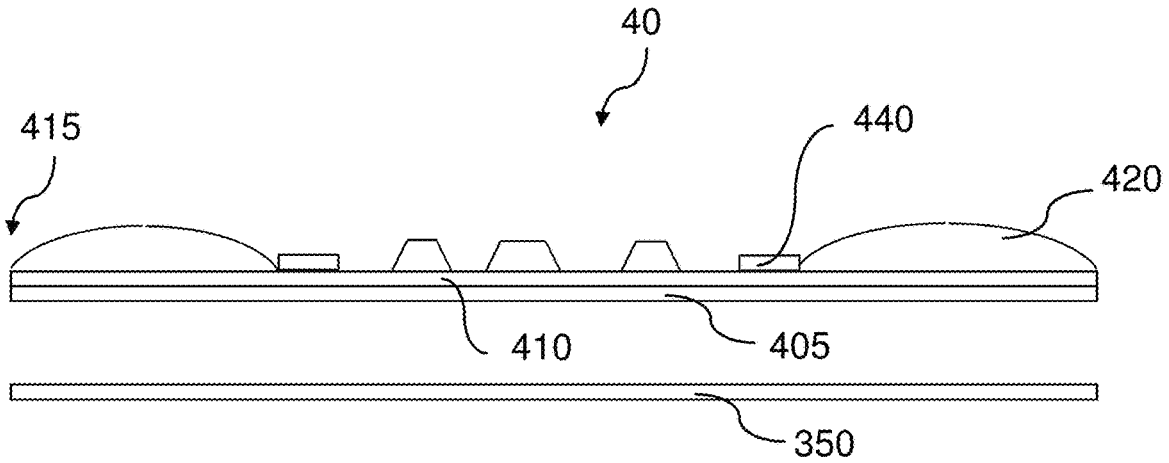
FIG. 3B represents, schematically and in cross section, a fourth particular embodiment of the label that is the subject of the present invention.
Figure 3C:
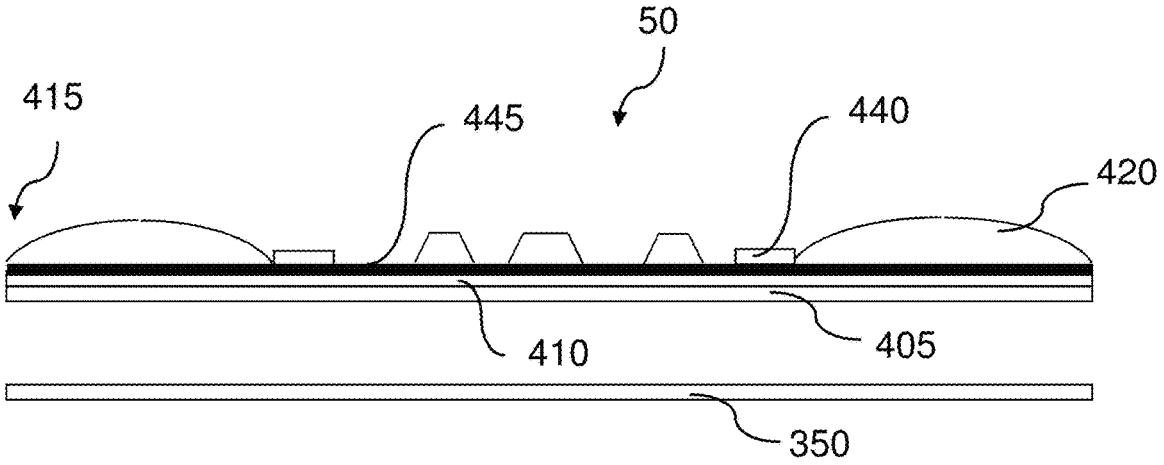
FIG. 3C represents, schematically and in cross section, a fifth particular embodiment of the label that is the subject of the present invention.
Figure 4:
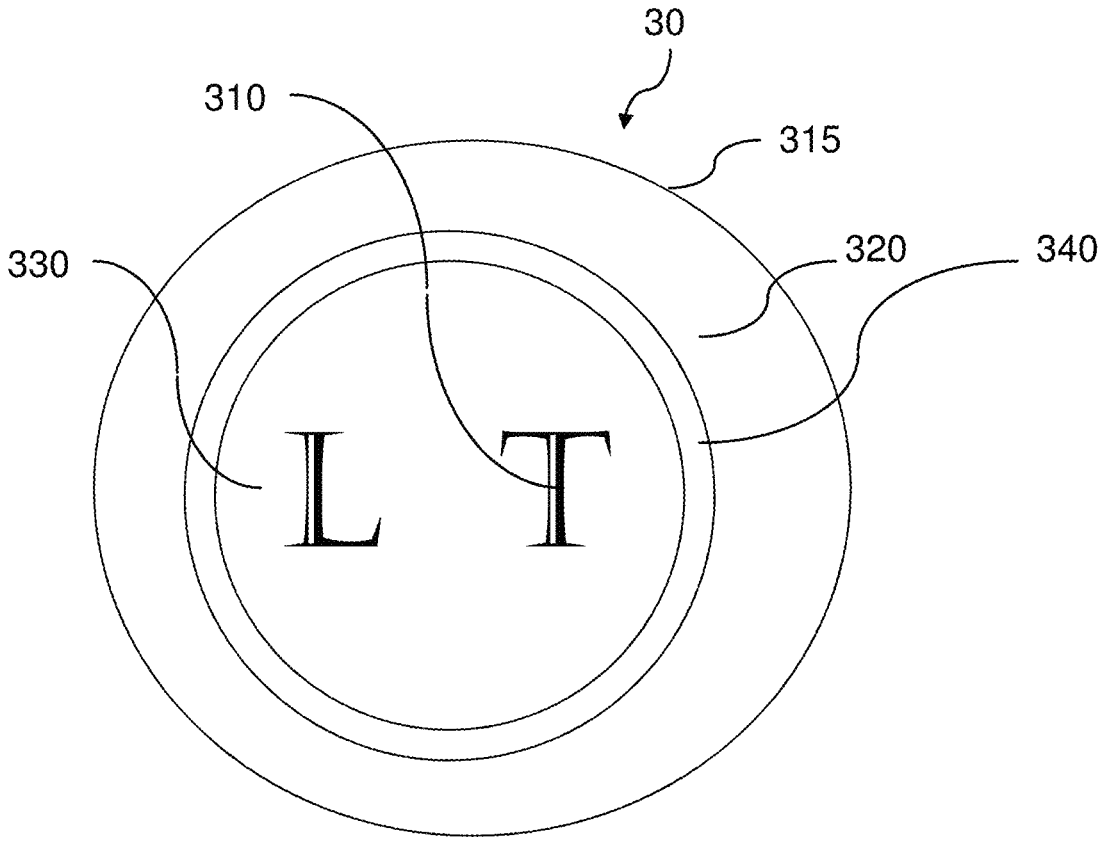
FIG. 4 represents, schematically, in a top view, the third particular embodiment of the label that is the subject of the present invention, illustrated in FIG. 3A.

Schematically, FIG. 1 shows a completely transparent label ("transparent 3D label"), FIG. 2 shows a transparent label, with a printed design ("tinted 3D label"), FIGS. 3A and 4 show an opaque label reproducing a wax seal ("wax seal label with lettering"), FIG. 3B shows a transparent label reproducing a glass seal ("glass seal label"), and FIG. 3C shows an opaque label reproducing a wax seal ("3D wax seal label").

These labels are designed to customize packaging in 3D, e.g. gift boxes or glass bottles. In the remainder of the description, for clarity, this last use is preferred, without limiting the scope of the present invention.

FIG. 1 shows a self-adhesive label 10 comprising:

a layer of adhesive 105;

a flexible plastic sheet 110, e.g. made of 60 μm thick polypropylene (PP); and an extra thickness 120 covering the edge 115 of the flexible plastic sheet 110.

The self-adhesive label 10 is laminated onto a removable PET/glassine backing 150 (shown unattached as it is not part of the label once it has been glued onto a glass bottle) for transportation. To form the extra thickness 120 of the flexible plastic sheet 110, a 3D acrylic ultraviolet ("UV") curing varnish is used, as set out with reference to FIG. 5.

In the embodiment illustrated in FIG. 1, the extra thickness of varnish 120, the adhesive 105 and the flexible plastic sheet 110 are, at least partially, transparent.

The extra thickness 120 is formed on the surface of the flexible plastic sheet 110 opposite the layer of adhesive 105. The extra thickness comprises a flexible plastic material and covers the edge 115 of the sheet to form a decorative design simulating an engraved or molded glass relief. The peripheries of the extra thickness 120 and of the flexible plastic sheet 110 are cut jointly. The cut edge 115 of the extra thickness 120 thus comes as a continuation of the cut edge of the sheet 110, up to the lower surface of the flexible plastic sheet 110.

Preferably, the angle of the jointly-cut edges of the extra thickness 120 and the flexible plastic sheet 110 to the lower surface of the flexible plastic sheet 110 is 90 degrees. This characteristic also applies to the other embodiments described with regard to the figures.

The extra thickness of varnish 120 forms a border in 3D at least 1.5 mm wide and at least 250 μm thick, which follows the outline of the label.

Preferably, the angle 130 of the surface of the sheet to the edge of the extra thickness of plastic material 120, at the limit of the joint cutting area, is over 45° to match an angle generally formed by a glass molding.

This border in relief 120 that follows the outline of the label 10 creates an esthetic barrier and has two functions:

- making the edges of the label 10 invisible once the label 10 has been pressed up against the glass of a bottle (not shown), thanks to a cutout in the mass of its outline; and
- partitioning two different materials, firstly the bottle's glass and secondly the synthetic material of the label 10, to prevent the consumer from comparing their aspect and brightness.

Figure 5:
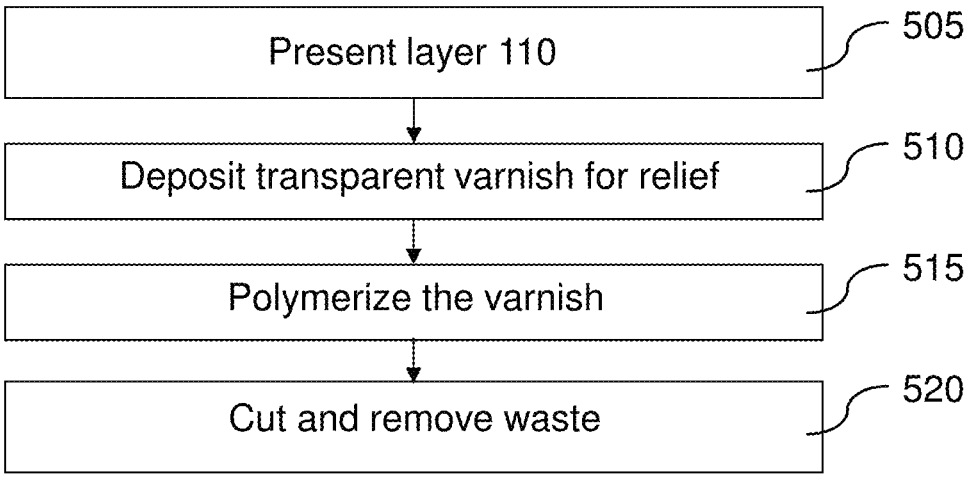
FIG. 5 represents, in the form of a logical diagram, steps in a first particular embodiment of the method that is the subject of the present invention.

As illustrated in FIG. 5, to produce the label 10, the following are utilized successively:

- a step 505 of presenting a flexible plastic sheet 110 assembled to a layer of adhesive 105 laminated onto a removable carrier 150;
- at least one step 510 of depositing UV-polymerized acrylic varnish to form a 3D extra thickness on the sheet 110 that follows the outline of the sheet 110;
- a step 515 of polymerizing the varnish and
- a step 520 of jointly cutting the periphery of the extra thickness and of the sheet, and of removing waste from the edges of the cut.

To produce the label 10, the following means can be utilized:

- an adhesive carrier is used, e.g. of type "PPTOP CLEAR" (registered trademark), translucent after complete polymerization of the adhesive in 48 hours. Its invisible and brilliant aspect, identical to glass, makes it possible to work on all types of tinted bottles, including clear glass bottles, even filled with clear alcohol, e.g. vodka; and
- the tension of the varnish film that forms the relief is achieved thanks to the use of a flexible Polyurethane squeegee to deposit as much UV varnish as possible.

The label 10 has the following characteristics and advantages:

- the sheet 110 of 60 μm transparent Polypropylene flexible plastic material, with a complexed backing 150 (PET/glassine paper ridge), makes the label completely translucent once affixed to a glass bottle, thanks to the absence of traces of adhesive due to the smoothing of the adhesive by the smooth PET backing; and
- the extra thickness comprises the border in relief 120, which follows the outline of the label and partitions the two materials (the bottle's glass and the label's visible material) and prevents the edges of the label 10 from being visible.

The label 10 is cost-effective, esthetically pleasing, and easy to install by hand or with a standard labeler fitted with ultrasound cells that detect the labels, even if they are transparent, and the reliefs. Utilizing it makes it possible to customize small, medium and large quantities of bottles at a low cost, while avoiding the constraints of glassmakers, such as capital investment for the mold, a large minimum quantity, required storage, blocked funds.

FIG. 2 shows a self-adhesive label 20 comprising:

- the layer of adhesive 105;
- the flexible plastic sheet 110, e.g. made of polypropylene; and
- a tinted extra thickness 220 covering the edge 115 of the flexible plastic sheet 110.

The self-adhesive label 20 is laminated onto a removable PET/glassine backing 150 (shown unattached as it is not part of the label once it has been glued onto a glass bottle) for transportation.

The label 20 has the same technical characteristics as the label 10, except that the flexible plastic sheet 110 bears a tinted design 220 rather than a transparent design. Preferably, the tinted 3D printing forming the extra thickness 220 is doubled with a transparent varnish. Preferably, the printed design of the extra thickness 220 is formed by a tinted layer of a transparent varnish and pigments of the color of the glass and a layer of the same varnish, transparent or also tinted, superimposed on the tinted layer.

The extra thickness 220 is formed on the surface of the flexible plastic sheet 110 opposite the layer of adhesive 105. The extra thickness comprises a flexible plastic and covers the edge 115 of the sheet 110 to form a decorative design simulating an engraved or molded glass relief. The peripheries of the extra thickness 220 and of the flexible plastic sheet 110 are cut jointly. The cut edge 115 of the extra thickness 220 thus comes as a continuation of the cut edge of the sheet 110, up to the lower surface of the flexible plastic sheet 110.

The varnish is a 3D UV varnish, for example an acrylic resin with UV polymerization. The pigments mixed with a transparent UV varnish produce a semi-transparent tint, transparent enough to let light pass through the bottle's glass and give a visually uniform result.

Applied to a glass bottle, the label 20 imitates the appearance and feel of a bottle with a 3D engraving or molding made by a glassmaker. Preferably, the color of the tint of the extra thickness 220 is the color of the glass of the bottle to which the label 20 is intended to be glued. Thus, the 3D printing is tinted with pigments to match the color of the glass of the bottle.

The label 20 is cost-effective, esthetically pleasing, can be printed in two or even three colors, and easy to affix by hand or with a standard labeler. Utilizing it makes it possible to customize small, medium and large quantities of bottles at a low cost, while avoiding the constraints of glassmakers.

Figure 6:
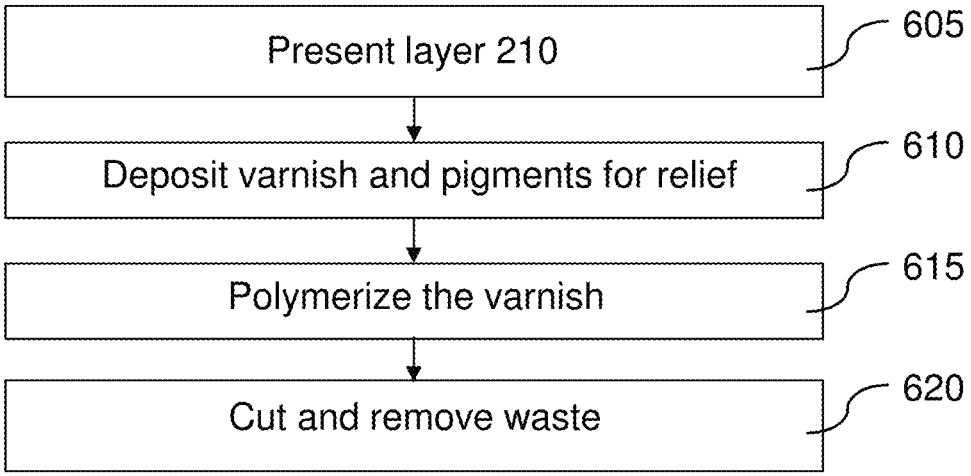
FIG. 6 represents, in the form of a logical diagram, steps in a second particular embodiment of the method that is the subject of the present invention.

As illustrated in FIG. 6, to produce the label 20, the following are utilized successively:

- a step 605 of presenting a flexible plastic sheet 110 assembled to a layer of adhesive 105 laminated onto a removable carrier 150;
- at least one step 610 of depositing UV-polymerizable acrylic varnish mixed with colored pigments to form a tinted 3D extra thickness relief on the flexible plastic sheet 110.
- a step 615 of polymerizing the varnish and
- a step 620 of jointly cutting the peripheries of the extra thickness and of the sheet, and of removing waste from the edges of the cut.

To produce the label 20, the following means can be utilized:

- an adhesive carrier is used, e.g. of type "PP Top Clear" (registered trademark), translucent after complete polymerization of the adhesive in 48 hours. Its invisible and brilliant aspect, identical to glass, makes it possible to work on all types of tinted bottles, including clear glass bottles, even filled with clear alcohol, e.g. vodka; and a flat-bed reel-to-reel screen printing machine is used, fitted with at least two print heads and with two UV-polymerization dryers and a flatbed cutter; Reel-to-reel rotary screen printing machines can also be used, fitted with at least two screen-printing heads and two UV-polymerization dryers and a rotary cutting station. For this configuration, the cylindrical screens replace the flatbed screen printing stencils. These provide improved definition through the technique for depositing varnish, faster print speeds and a more reliable, higher-quality rotary cut. A flexible printing squeegee is used.

a screen printing stencil destined for a first printing stage is made with a polyester fabric and a medium mesh size. This first screen printing is made with the 3D varnish from VFP or DUBUIT (registered trademarks). These varnishes are tinted with MICROLITH pigments from BASF (registered trademarks), assembled and marketed by ENCRES DUBUIT (registered trademark), making it possible to reproduce the color of the bottle glass by matching;

a screen printing stencil destined for a second printing stage is made with a polyester fabric and a large mesh size. This second screen printing is carried out exclusively with the "UV RELEX" (registered trademark) 3D varnish from VFP or the HMA 3034 varnish from ENCRES DUBUIT (registered trademarks). These varnishes can also be tinted. This second printing is only to provide relief, transparency and brilliance;

the tension of the varnish film is achieved by using a flexible squeegee; and the number of printing cycles per hour is 1100 cycles/hour.

The label 20 has the following characteristics and advantages:

a 3D printing with pigments to match the color of the bottle glass gives the illusion to the consumer that the bottle's material is engraved;

a multi-layer printing method consisting of superimposing a first layer tinted to the same color as the glass, a layer of transparent or tinted varnish makes it possible to obtain the relief while preventing the risks of visible detection;

a border in relief of the extra thickness 220, which follows the outline of the label partitions the two materials and prevents the edges of the label being visible; and the ability to have two or three different colors in relief on a single bottle, which a glassmaker cannot achieve.

FIGS. 3A and 4 show a self-adhesive label 30 simulating a wax seal and comprising:

a layer of adhesive 305;

a sheet 310 of metallized polyester, for example, 80 μm thick; and a layer 320 of flexible plastic material forming an extra thickness whose periphery is cut jointly with the periphery of the sheet 310.

For the label 30 to have the shape of a wax seal, the layer 320 forms a 3D border (or a rim) that follows the irregular outlines of the label 30 and covers the edge 315 of the sheet 310.

The extra thickness 320 is formed on the surface of the flexible plastic sheet 310 opposite the layer of adhesive 305. The extra thickness 320 comprises a flexible plastic material and covers the edge 315 of the sheet to form a decorative design simulating an edge of a seal. The peripheries of the extra thickness 320 and of the flexible plastic sheet 310 are cut jointly. The cut edge 315 of the extra thickness 320 thus comes as a continuation of the cut edge of the sheet 310, up to the lower surface of the flexible plastic sheet 310.

Preferably, the angle of the surface of the sheet 310 to the edge of the extra thickness of plastic material 320, at the limit of the joint cutting area, is over 45°.

The self-adhesive label 30 is laminated onto a removable PET/glassine carrier 350 (shown unattached as it is not part of the label once it has been glued onto a glass bottle) for transportation.

The sheet 310 carries a print 330 and a circular "resin stop" molding 340 printed with an aqueous or UV varnish, configured to repel a predefined flexible plastic material, the layer 320 being formed with this predefined flexible plastic material being poured before hardening. For example, the extra thickness 320 is made of polyurethane resin mixed with isocyanate hardener, which cures when heated. Preferably, the material of the extra thickness 320 is transparent so there is continuity of color between, firstly, the central portion, where the color of the printing 330 is directly seen and, secondly, the extra thickness 320 through which the color of the printing 330 is seen.

The sheet 310 bears, on the side opposite the adhesive, the printing of a solid color area with text in a margin, allowing the gold or silver metallized color of the sheet 310 to be seen. The text ("LT" in FIG. 4) thus appears in a box by not printing the solid area.

It should be noted that the polyurethane resin used complies with all current standards: ROHS, toys, food, automobile, lead- and mercury free, no heavy metals. To pour the resin, called "doming", a special machine is used, for example, which is able to reproduce all the shapes and texts from 3 to 4 mm wide, with a thickness of over 1.5 mm. This machine is fitted with an arm articulated around two digital axes able to reproduce any form based on a computer file using vector drawing programs.

The computer file that made it possible to make the cutting tool is also used for programming the various motions of the arm, on which nozzles are arranged (from 2 to 24 nozzles, in even numbers, depending on the number of seals per sheet), which carry the exact quantity of resin propelled by metering pumps according to a preselected program.

This machine is fitted with a suction table to receive the backing sheets with pre-printed seals. The suction and positioning of the sheet during the "doming" period must be perfect, so that the poured resin perfectly follows the seal's outlines.

The advantages of the label 30 comprise, compared to a conventional wax seal:

the label 30 eliminates the painstaking set up for a genuine "wax seal", where the wax has to be softened, poured onto the object, the wax stamped with a more or less successful rendering, all with low yields; and the label 30 is delivered on backing sheets; the label 30 can be removed from its carrier and glued by hand onto its new carrier, as easily and quickly as a self-adhesive sticker; This operation can be carried out in hidden time, since it requires no implementation and no particular know-how to achieve a visual with perfect and constant quality;

the label 30 adopts geometrically involute shapes, unlike a wax seal;

the label 30 is made from flexible, highly resilient materials that meet industrial specifications, unlike "wax seals", which are fragile, breakable, deformable, and can deteriorate;

the label 30 can be produced in all colors, with no colorimetric limitations, and its shape is scalable;

unlike a monochrome wax seal, a gold or silver center design (logo, coat of arms) can be achieved; and the label 30 can be manufactured in large series to meet large requirements, e.g. at a rate of 40,000 seals/day.

Figure 7:
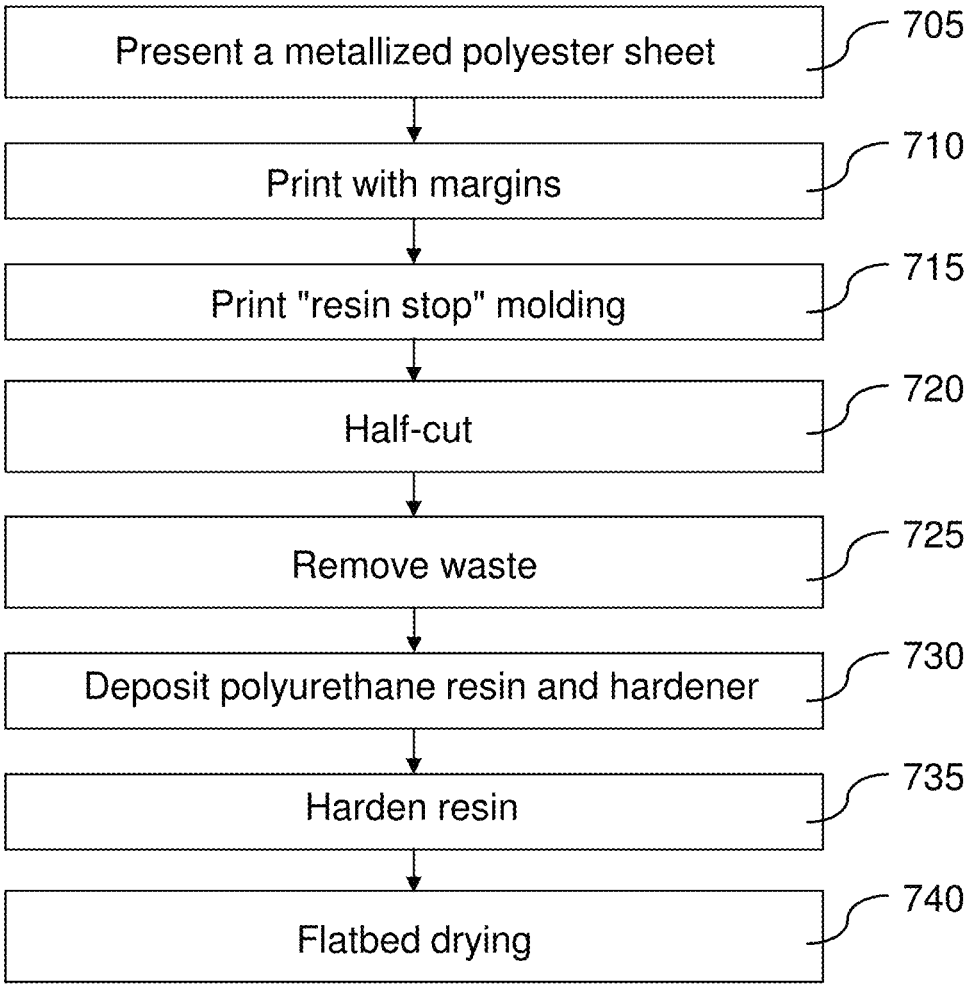
FIG. 7 represents, in the form of a logical diagram, steps in a third particular embodiment of the method that is the subject of the present invention.

As illustrated in FIG. 7, to produce the label 30, the following means can be utilized:

during a step 705, a sheet of self-adhesive metallized polyester is positioned, laminated onto a silicone paper or glassine backing;

during a step 710, a solid color area with margins (round border matching the inner shape of a stamp, initials, coats of arms, vintages, etc.) is screen printed on the polyester sheet with a UV-curing matte ink so as to achieve an opaque background and a bright gold or silver visual;

during a step 715, around the printed central visual, a circular "ink stop" or "resin stop" molding 1 mm wide is screen printed with an aqueous or UV varnish specially formulated and manufactured by CHEMQUE (registered trademark), which forms a delineating barrier to stop the polyurethane resin during the "doming" or "resin depositing" operation (step 420). Its property consists of repelling the polyurethane resin during its spreading phase, the goal being to control exactly the places where it is desired that the resin spreads or does not spread over well-defined areas, hence the name "selective resin";

during a step 720, the shape of a wax seal, selected beforehand at a distance of 4, 5 or 6 mm from the circular "resin stop" molding, is half-cut, using a die cutting tool fixed to a cutting plate or a computer-aided digital cutting plotter (e.g. machine for cutting vinyl to a shape). Thus, only the extra thickness 320 and the thickness of the PVC PP or polyolefin sheet 310 are cut, not that of the silicone paper forming the backing;

during a step 725, once the extra thickness and polyester sheet have been cut, the surplus portions of the sheet are removed, leaving only the shapes of the pre-cut screen-printed seals with a bright gold or silver visual to appear on the silicone sheet;

during a step 730, the polyurethane resin mixed with isocyanate hardener is poured outside the "resin stop" molding, the resin stopping when it abuts the cut carried out in step 720; the difference in the levels of the edges of the cut in the PVC, PP or polyolefin sheet and the "resin stop" border stop the resin thanks to a physicochemical balance through a combination of the formulation of the polyurethane resin and the surface tension of the printed carrier;

during a step 735, polymerization of the polyurethane resin, and therefore of the rim 320, is caused with a hardener; the completely translucent resin gives a 3D magnifier effect to the color background, and a 3D dome aspect. Managing the volume of resin in relation to the surface to be covered makes it possible to reproduce the relief of a genuine wax seal (about 2.5 mm high). It is impossible to manufacture 3D of this quality either in terms of height or look by any other method; and during a step 740, the sheets of seals, once domed, are stored flat on drying racks. The resin is thoroughly dried, for example for about six hours at a temperature of 35° C. to 40° C. and humidity regulated to 40%.

FIG. 3B shows a self-adhesive label 40 simulating a wax seal and comprising:

a layer of transparent adhesive 405;

a sheet 410 of PVC PP or transparent polyolefin, for example, 60 or 100 μm thick; and a layer 420 of transparent flexible plastic material forming an extra thickness whose periphery is cut jointly with the periphery of the sheet 410, the cut edge of the extra thickness thus coming as a continuation of the cut edge of the sheet 410 up to the lower surface of the sheet of flexible plastic 410.

For the label 40 to have the shape of a glass seal, the layer 420 forms a 3D border that follows the irregular outlines of the label 40 and covers the edge 415 of the sheet 410. Preferably, the angle of the surface of the sheet to the edge of the extra thickness of plastic material, at the limit of the joint cutting area, is over 45°.

The self-adhesive label 40 is laminated onto a removable PET/glassine carrier 350 (shown unattached as it is not part of the label once it has been glued onto a glass bottle) for transportation.

The sheet 410 carries a 3D printing in its central portion and outside the border 420. This 3D printing is made in the same way as the printing in relief of the labels 10 and 20, as set out with reference to FIGS. 1, 2, 5 and 6.

The sheet 410 has a circular "resin stop" molding 440 printed with a UV varnish, configured to repel a predefined flexible plastic material, the layer 420 being formed with this predefined flexible plastic material being poured before hardening. For example, the layer 420 is made of polyurethane resin mixed with isocyanate hardener, which cures when heated.

The label 40 avoids having to mold the glass of a bottle to form a decorative relief on it.

Figure 8:
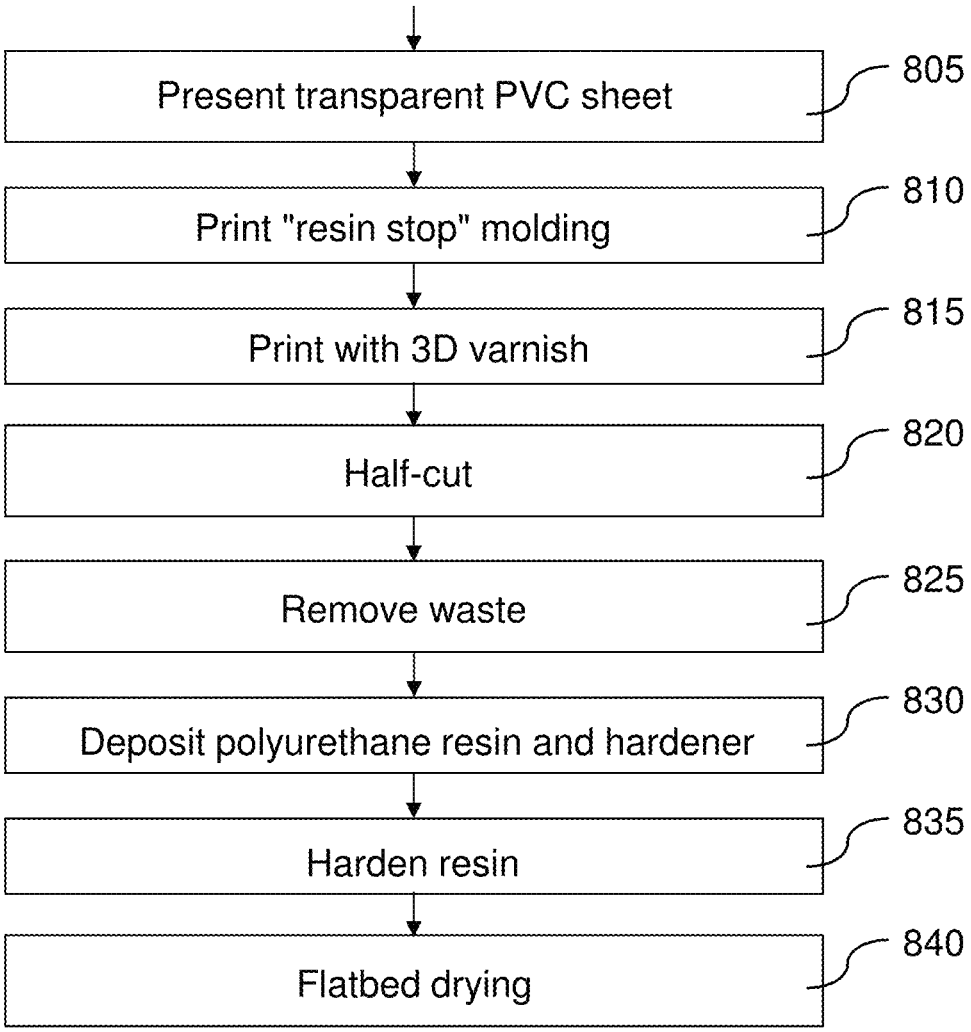
FIG. 8 represents, in the form of a logical diagram, steps in a fourth particular embodiment of the method that is the subject of the present invention.

As illustrated in FIG. 8, to produce the label 40, the following means can be utilized:

during a step 805, a sheet of self-adhesive transparent PVC is positioned, laminated onto a glassine backing;

during a step 810, a circular "ink stop" or "resin stop" molding 1 mm wide is screen printed with an aqueous or UV varnish specially formulated and manufactured by CHEMQUE (registered trademark), which forms a delineating barrier to stop the polyurethane resin during the "doming" or "resin depositing" operation (step 420). Its property consists of repelling the polyurethane resin during its spreading phase, the goal being to control exactly the places where it is desired that the resin spreads or does not spread over well-defined areas, hence the name "selective resin";

during a step 815, a transparent UV curing acrylic relief varnish is screen printed on the central portion;

during a step 820, the shape of a wax seal, selected beforehand at a distance of 4, 5 or 6 mm from the circular "resin stop" molding, is half-cut, using a die cutting tool fixed to a cutting plate or a computer-aided digital cutting plotter (e.g. machine for cutting vinyl to a shape). Thus, only the extra thickness and the thickness of the PVC PP or transparent polyolefin sheet are cut, not that of the silicone paper;

during a step 825, once the extra thickness and the polyester sheet have been cut, the surplus portions of the sheet are removed, leaving only the shapes of the pre-cut stamps screen printed in relief and tinted with a bright gold or silver visual to appear on the silicone sheet;

during a step 830, the polyurethane resin mixed with isocyanate hardener is poured outside the "resin stop" molding, the resin stopping when it abuts the cut carried out in step 820; the difference in the levels of the edges of the cut in the PVC sheet and the "resin stop" border stops the resin thanks to a physicochemical balance through a combination of the formulation of the polyurethane resin and the surface tension of the carrier;

during a step 835, polymerization of the polyurethane resin, and therefore of the rim 420, is caused with a hardener; the completely translucent resin gives a 3D magnifier effect to the color background, and a 3D dome aspect. Managing the volume of resin in relation to the surface to be covered makes it possible to reproduce the relief of a genuine wax seal (about 2.5 mm high). It is impossible to manufacture 3D of this quality either in terms of height or look by any other method; and during a step 840, the sheets of seals, once domed, are stored flat on drying racks. The resin is thoroughly dried, for example for about six hours at a temperature of 35° C. to 40° C. and humidity regulated to 40%.

FIG. 3C shows a self-adhesive label 50 simulating a wax seal and comprising:

a layer of adhesive 405;

a sheet 410 of PVC PP or transparent polyolefin, for example, 100 μm thick; and a layer 420 of flexible plastic material forming an extra thickness whose periphery is cut jointly with the periphery of the sheet 410, the cut edge of the extra thickness thus coming as a continuation of the cut edge of the sheet 410 up to the lower surface of the sheet of flexible plastic 410.

The label 50 is similar to the label 40, except for an additional printing 445 on the sheet 410 on the side opposite the adhesive 405, of two screen printed solid areas of UV curing matte ink superimposed on each other to obtain a completely opaque color background. A label simulating a monochrome wax seal is thus produced without the drawbacks of a wax seal.

Figure 9:
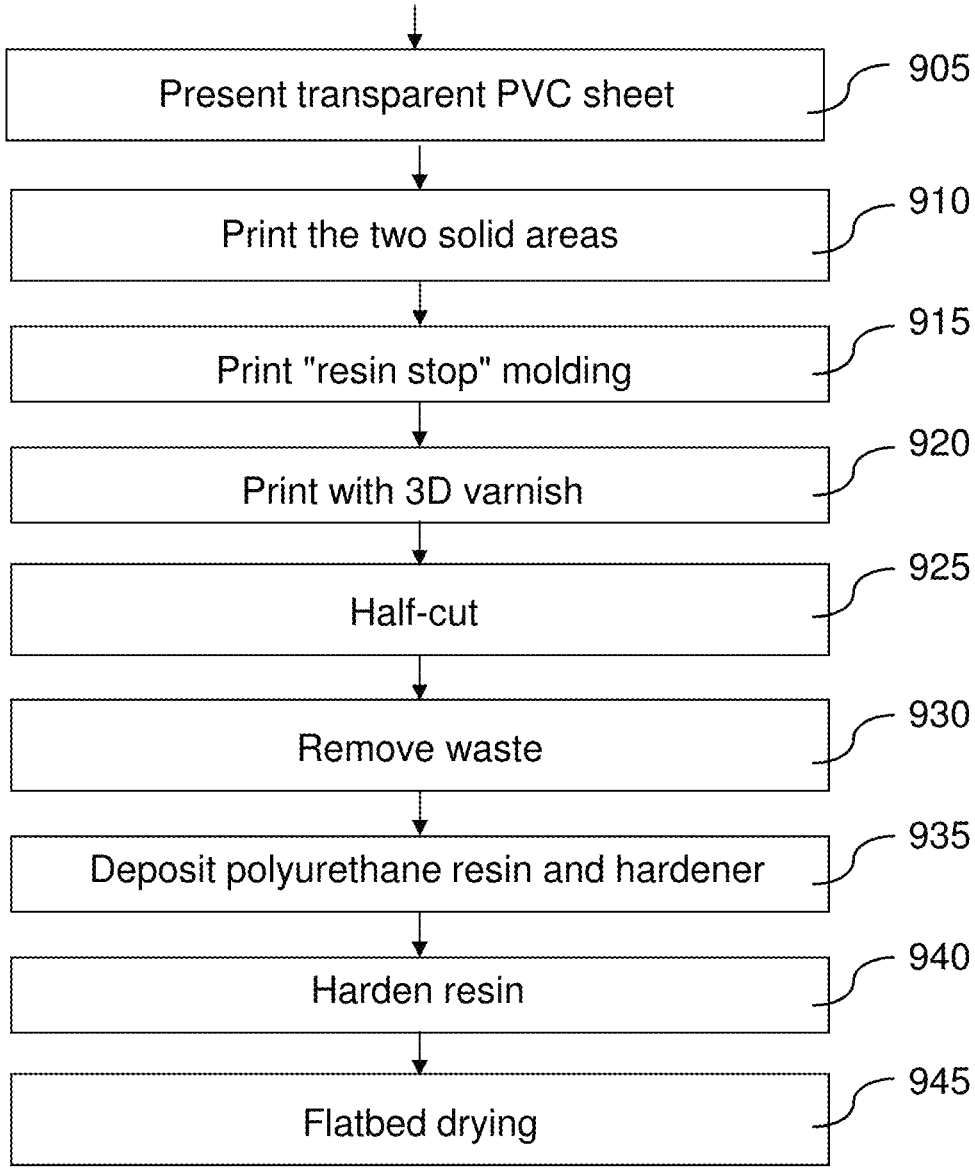
FIG. 9 represents, in the form of a logical diagram, steps in a fifth particular embodiment of the method that is the subject of the present invention.

As illustrated in FIG. 9, to produce the label 50, the following means can be utilized:

during a step 905, a sheet of self-adhesive transparent PVC, PP or polyolefin is positioned, laminated onto a glassine backing;

during a step 910 two solid areas, superimposed on each other so as to achieve a completely opaque background, are screen printed on the PVC, PP or polyolefin sheet with a UV-curing matte ink;

during a step 915, a circular "ink stop" or "resin stop" molding 1 mm wide is screen printed with an aqueous or UV varnish specially formulated and manufactured by CHEMQUE (registered trademark), which forms a delineating barrier to stop the polyurethane resin during the "doming" or "resin depositing" operation (step 420). Its property consists of repelling the polyurethane resin during its spreading phase, the goal being to control exactly the places where it is desired that the resin spreads or does not spread over well-defined areas, hence the name "selective resin";

during a step 920, a UV curing acrylic relief varnish, tinted according to the color of the solid areas, is screen printed on the central portion;

during a step 925, the shape of a wax seal, selected beforehand at a distance of 4, 5 or 6 mm from the circular "resin stop" molding, is half-cut, using a die cutting tool fixed to a cutting plate or a computer-aided digital cutting plotter (e.g. machine for cutting vinyl to a shape). Thus, only the extra thickness and the thickness of the PVC PP or transparent polyolefin sheet are cut, not that of the silicone paper;

during a step 930, once the extra thickness and the PVC, PP or polyolefin sheet have been cut, the surplus portions of the sheet are removed, leaving only the shapes of the pre-cut screen-printed seals with a 3D tinted visual to appear on the silicone sheet;

during a step 935, the polyurethane resin mixed with isocyanate hardener is poured outside the "resin stop" molding, the resin stopping when it abuts the cut carried out in step 925; the difference in the levels of the edges of the cut in the PVC sheet and the "resin stop" border stop the resin thanks to a physicochemical balance through a combination of the formulation of the polyurethane resin and the surface tension of the printed carrier;

during a step 940, polymerization of the polyurethane resin, and therefore of the rim 420, is caused with a hardener; the completely translucent resin gives a 3D magnifier effect to the color background, and a 3D dome aspect. Managing the volume of resin in relation to the surface to be covered makes it possible to reproduce the relief of a genuine wax seal (about 2.5 mm high). It is impossible to manufacture 3D of this quality either in terms of height or look by any other method; and during a step 945, the sheets of seals, once domed, are stored flat on drying racks. The resin is thoroughly dried, for example for about six hours at a temperature of 35° C. to 40° C. and humidity regulated to 40%.

Figure 10:
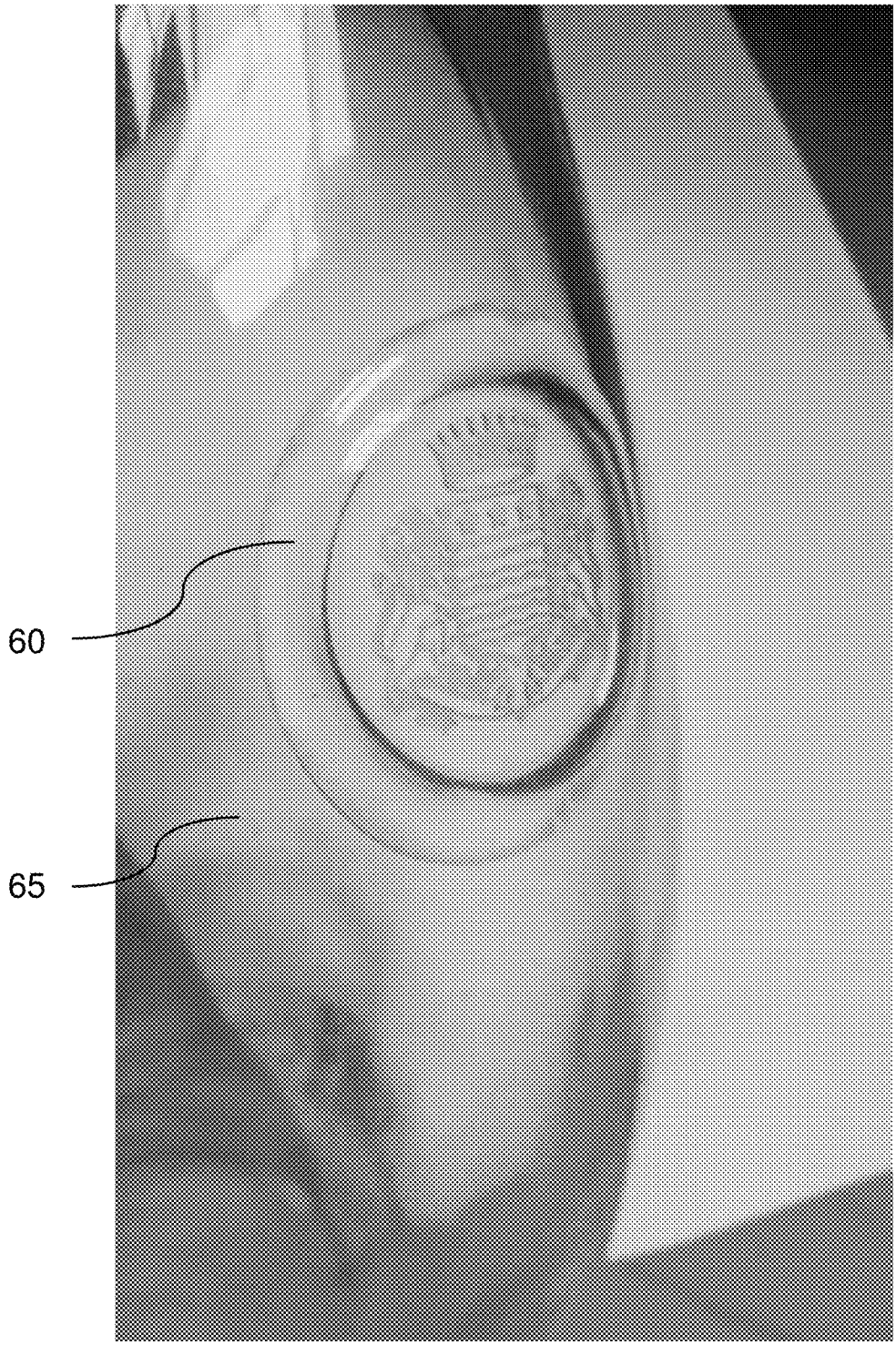
FIGS. 10-13 represent, in the form of photographs, labels that are the subjects of the present invention glued onto bottles.
Figure 11:
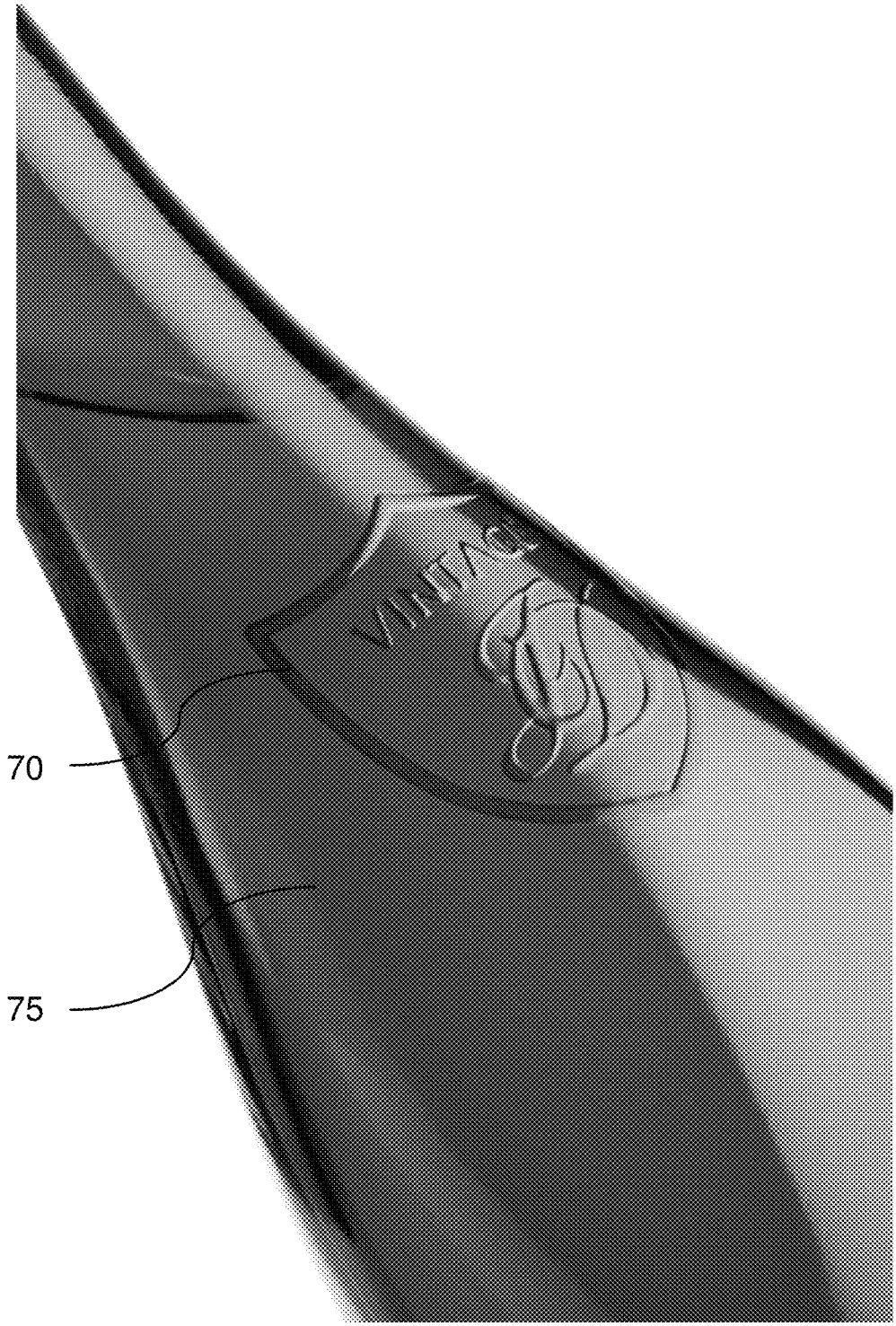
Figure 12:
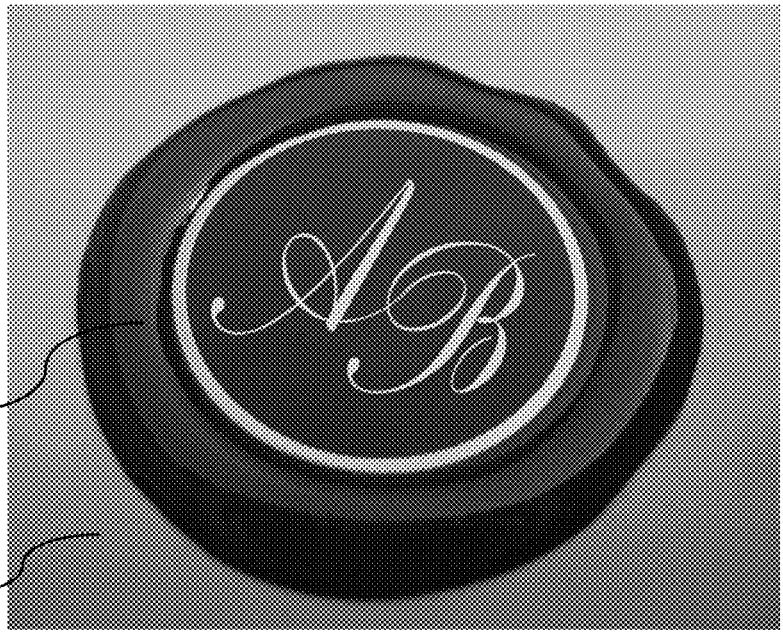
Figure 13:
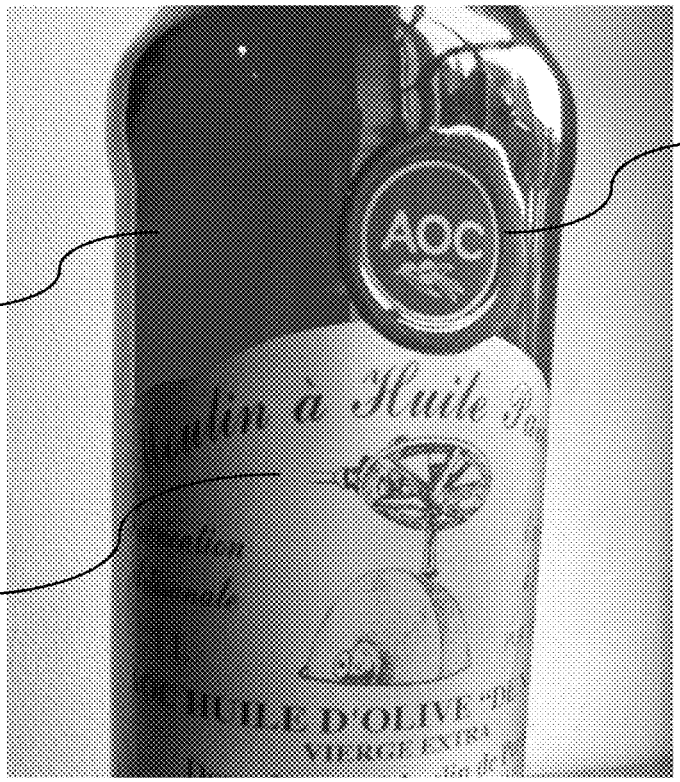

FIGS. 10-13 represent, as photographs, labels that are the subjects of the present invention glued onto bottles:

FIG. 10 shows a transparent glass seal label 60 affixed on a bottle 65; as can be seen, the separations between the glass, the flexible plastic sheet, and the extra thickness are invisible;

FIG. 11 shows a tinted 3D label 70 affixed on a bottle 75; as can be seen, the separations between the glass, the flexible plastic sheet, and the extra thickness are invisible and the tint of the label matches the tint of the glass that forms the bottle;

FIG. 12 shows a wax seal label 80 with lettering affixed on a bottle 85; as can be seen, the separation between the flexible plastic sheet and the extra thickness are invisible;

FIG. 13 shows a wax seal label 90 with lettering affixed on a bottle 95 and onto a paper label 97; as can be seen, the separation between the flexible plastic sheet and the extra thickness are invisible.

Of course, the various embodiments can be combined to form other types of labels. For example, a label may have the printing with margins on metallized polyester sheets as illustrated in FIGS. 3A, 4 and 7, and a transparent relief superimposed on this printing, as illustrated in FIGS. 3C and 9. Similarly, the printed reliefs illustrated in FIGS. 3B, 3C 8 and 9 can be made with a tinted varnish as set out with reference to FIGS. 2 and 6.

In a variant, to make the extra thickness of the label, 3D UV inkjet printing is utilized, similar to inkjet printing but without necessarily the material being tinted. In some variants, during the step of forming an extra thickness, a digital UV ink jet printing is carried out, thanks to a UV varnish deposited in multiple layers.

The thickness of such a printing can reach, for example 500 μm.

Small and medium-size runs of labels can be handled and tooling costs sharply reduced. For labels designed to customize clear glass bottles, during the application by inkjet of the varnish in 3D, a complete absence of air bubbles is noted, giving at the end a completely translucent varnish, unlike a screen-printed varnish that may become laden with bubbles and lose its transparency.

In some variants, embossing or forming and thermoforming techniques are utilized, which consist of deforming the synthetic or paper backing and giving it a relief forming an extra thickness.

In some variants, a postcure or remelting of the label is utilized, before or after it is affixed to the container, to reduce internal tensions and improve the label's conforming to the surface of the container, which may be curved and non-involute.

Figure 14:
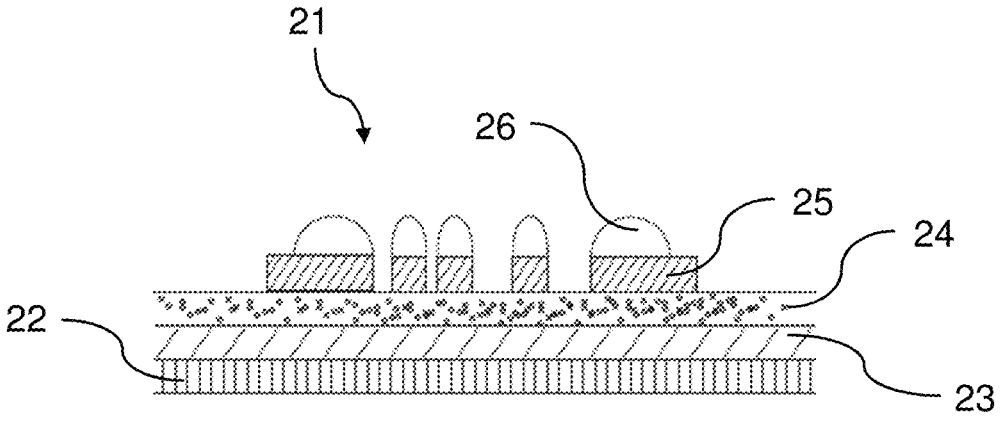
FIG. 14 represents, schematically and in cross section, a sixth particular embodiment of the label that is the subject of the invention before being cut.
Figure 15:
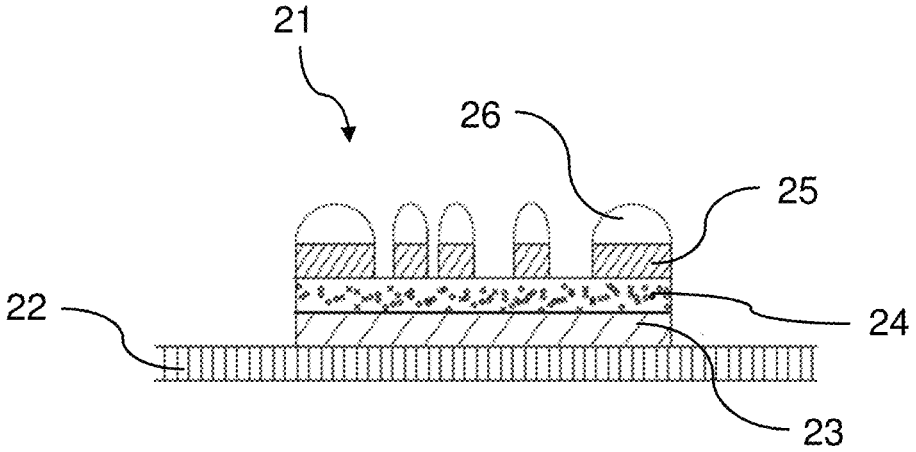
FIG. 15 represents, schematically and in cross section, the label shown in FIG. 14, after being cut.
Figure 16:
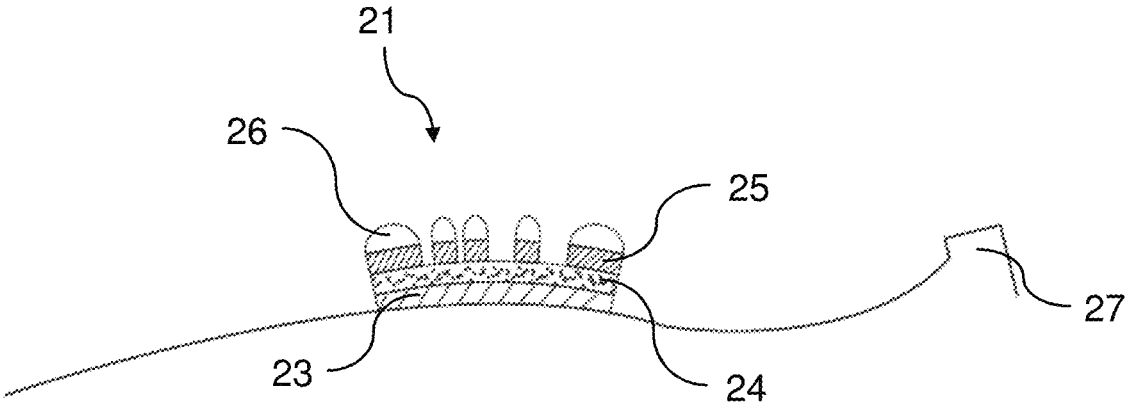
FIG. 16 represents, partially and in cross section, a bottle on which the label shown in FIGS. 14 and 15 is stuck.

In the embodiment of the label shown in FIGS. 14 to 16, the label 21 according to the invention comprises, successively:

a backing 22, for example PET/glassine paper ridge, glassine or silicone paper, a layer of adhesive 23, a flexible plastic sheet 24, preferably made of transparent material, e.g., a sheet of 60 μm transparent Polypropylene flexible plastic material, PVC or transparent polyolefin.

an undercoat varnish 25 positioned on the flexible plastic sheet 24, and an overcoat varnish 26 positioned on the undercoat varnish 25.

The undercoat varnish 25 and the overcoat varnish 26 are configured to repel each other, so that the overcoat varnish 26 is retracted into the shape of a drop.

Thanks to these features, the label exhibits a relief or thickness that is higher than all the other printing techniques known to the person skilled in the field, the relief having a "water drop" effect or "doming effect". Moreover, the label exhibits a perfect surface appearance: the retraction of the varnish on itself results in a uniform surface finish, smooth on the surface, very glossy and rounded, which captures the light reflections. This appearance is comparable to the reliefs of molded patterns that customize glass bottles.

In embodiments, the undercoat varnish 25 and the overcoat varnish 26 are immiscible varnishes.

In embodiments, the spreading coefficient of the overcoat varnish 26, when liquid, on the polymerized undercoat varnish 25 is a negative value In embodiments, the undercoat varnish 25 and/or the overcoat varnish 26 is polymerized under ultraviolet rays.

In embodiments, the undercoat varnish 25 is formulated with surfactants on a polyurethane base.

In embodiments, the undercoat varnish 25 includes silicone.

In embodiments, the overcoat varnish 26 is formulated on an acrylic/polyurethane base.

In embodiments, the overcoat varnish 26 is "silicone free", i.e., formulated without siliconized surfactant.

To manufacture the label, screen printing of a semi-rigid transparent 3D varnish with a "water drop" effect can be used. For example, the following tools and material mays be used

- a reel-to-reel screen printing line, for example 350 mm wide with two colors;
- a screen-printing stencil, for example taut, with a 77 threads/cm mesh polyester fabric coated with a multilayer photosensitive emulsion (100 microns);
- an undercoat varnish, polymerized under ultraviolet rays, about 80 microns thick, translucent or tinted according to the predefined color of the bottle to which the label is to be glued. This varnish is specially formulated, for example with surfactants on a 100% polyurethane base to obtain maximum flexibility;
- a screen-printing stencil, for example taut, with a stainless steel large-hole mesh gauze coated with a thick photosensitive emulsion layer, e.g., 250 microns;
- a 3D overcoat varnish polymerized with ultraviolet rays, for example specially formulated on an acrylic/polyurethane base, to combine flexibility in the mass and surface resistance without siliconized surfactant, to obtain excellent transparency. This type of 3D UV varnish is called "silicone free";
- a screen-printing squeegee, for example 75 shores; and
- a slow print speed, for example 10 meters per minute.

When two UV varnishes are used, they are printed in the following order:

The translucent or tinted varnish, formulated from polyurethane with silicone, is printed as the undercoat varnish 25. The silicone-free transparent varnish 26 with an acrylic/polyurethane base is superimposed true to register on the undercoat varnish 25. Once superimposed, because of their relative surface tension, the two varnishes 25 and 26 repel each other. The superimposed transparent varnish 26 retracts into itself, producing the looked-for "water drop" effect. Instead of spreading after printing like a conventional varnish, this retraction gives the varnish 26, on the contrary, volume, thickness and a rounded shape.

The invention provides:

- a relief better than all the other printing techniques known to the person in the field, thanks to the "water drop" or "doming effect";
- a perfect surface appearance: the retraction of the varnish on itself results in a uniform surface finish, smooth on the surface, very glossy and rounded, which captures the light reflections. This appearance is comparable to the reliefs of molded patterns that customize glass bottles;
- exceptional adhesion, thanks to the naturally sticky polyurethane undercoat. Its excellent adhesive power on all synthetic surfaces serves as interface between the 3D varnish and the adhesive carrier;
- great flexibility of the entire label: thanks to its very flexible undercoat, which acts as shock mount, the label can be stretched more than 20%; and
- an ability of the label 21 to be fixed with pressure, which makes it possible to remove the bubbles between the label and the mounting surface, for example the glass of a bottle, thereby preventing the appearance of unsightly bubbles that would make the simulation of glass molding futile.

Figure 18:
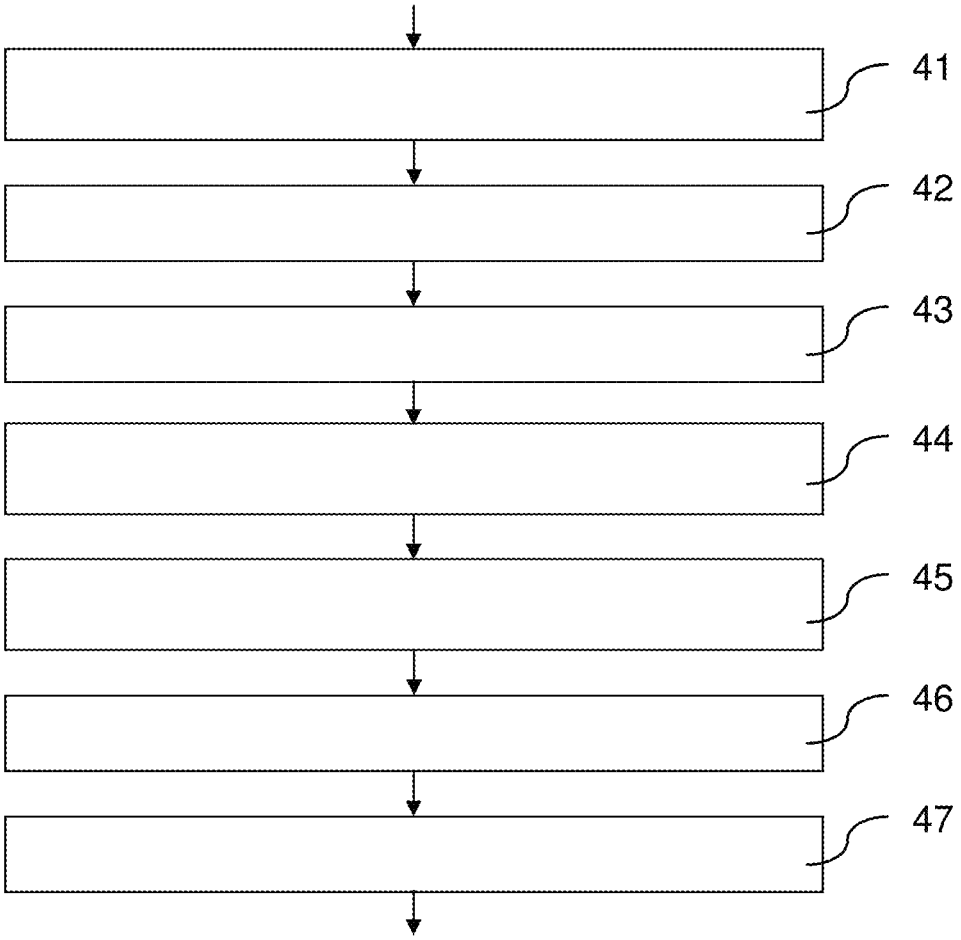
FIG. 18 represents, in the form of a logical diagram, steps in a particular embodiment of a method to manufacture the label shown in FIGS. 14 to 16.

FIG. 18 represents, in the form of a logical diagram, steps in a particular embodiment of a method to manufacture the label shown in FIGS. 14 to 16.

The method of manufacturing a self-adhesive label produced in relief in order to visually and/or tactilely simulate a decorative molding of a material of a container or a decorative seal or stamp applied to the container, comprises:

a step 41 of applying adhesive onto a first surface of a flexible plastic sheet, the flexible plastic sheet having a second surface opposite the first surface;

a step 42 of printing a molding with a side varnish configured to repel the undercoat varnish;

a step 43 of half-cutting the shape of the label so as to cut only the thickness of the sheet and not that of the removable carrier;

a step 44 of applying, on the second surface of the flexible plastic sheet, an undercoat varnish; during which undercoat varnish is poured outside the side varnish, the undercoat varnish stopping when it abuts the cut and a step 45 of applying, on the undercoat varnish, an overcoat varnish, wherein the undercoat varnish and the overcoat varnish are configured to repel each other, so that the overcoat varnish is retracted into the shape of a drop.

a step 46 of hardening the undercoat varnish.

In the particular embodiment shown on FIG. 18, the method further comprises a step 47 of jointly cutting i) a periphery of the undercoat varnish, ii) a periphery of the overcoat varnish and iii) a periphery of the flexible plastic sheet to thereby form a cut edge in the extra thickness comprising the undercoat varnish and the overcoat varnish and in the flexible plastic sheet, so that the cut edge of the extra thickness is formed as a continuation of the cut edge of the flexible plastic sheet up to a lower surface of the flexible plastic sheet.

Figure 17:
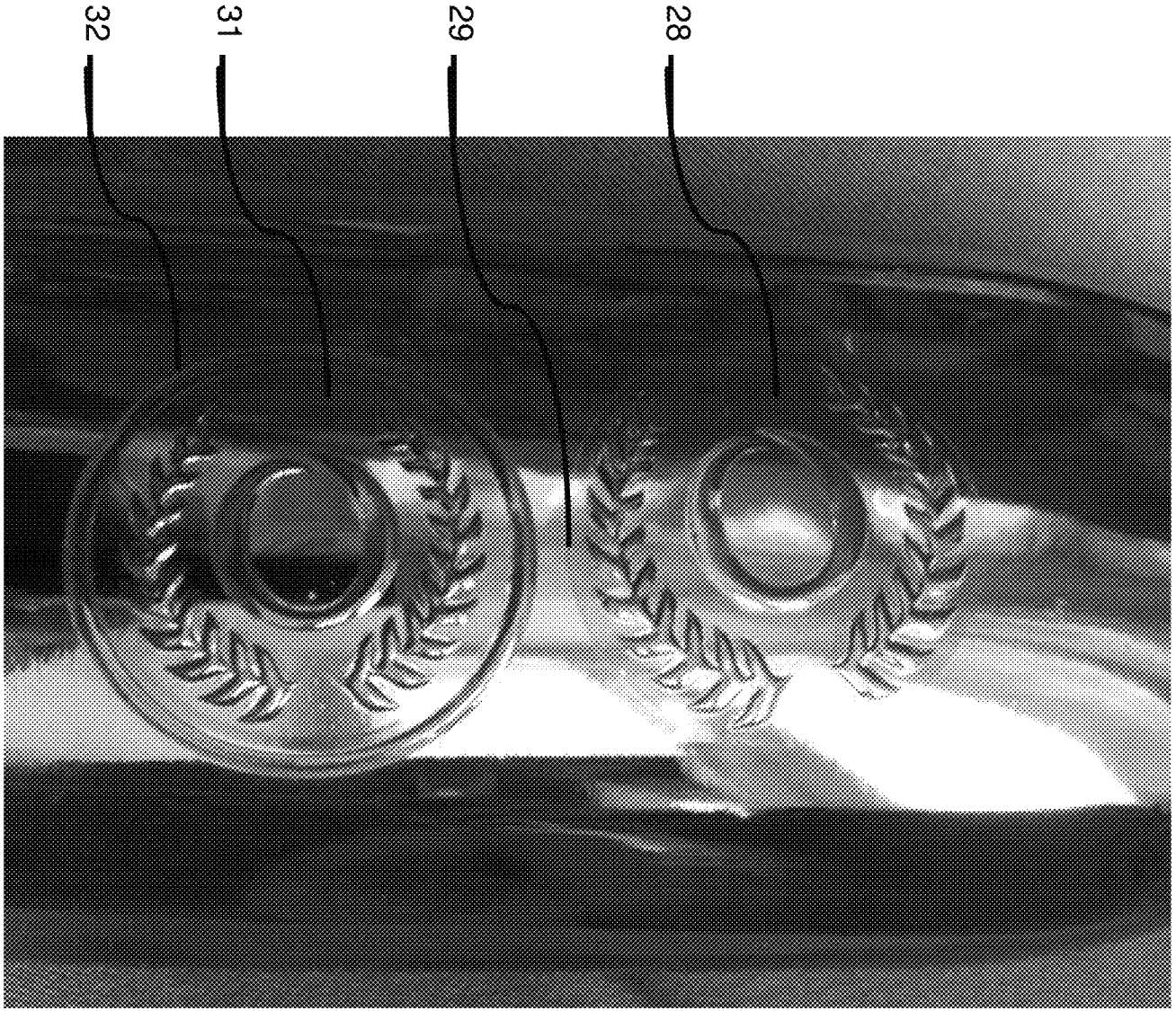
FIG. 17 represents a photograph of a bottle bearing two labels.

The self-adhesive label then better visually simulates a decorative molding of a material, as shown in the lower part of FIG. 17, that represents a photograph of a bottle bearing two labels. In label 28, the cut edge 29 of the flexible plastic sheet is seen, the stuck label 28 looking like a stuck label.

To the contrary, in label 31, because the peripheries of the extra thickness and of the sheet of plastic are cut jointly, the cut edge of the extra thickness comes as a continuation of the cut edge of the sheet up to the lower surface of the flexible plastic sheet. The cut edge 32 of the flexible plastic sheet cannot be separately seen, the stuck label 31 looking like a mold of the bottle bearing the labels 28 and 31.

The invention claimed is:

1. A self-adhesive label produced in relief in order to visually and/or tactilely simulate a decorative molding of a material of a container or a decorative seal or stamp applied to the container, the self-adhesive label comprising, successively:

a layer of adhesive, a flexible plastic sheet, an undercoat varnish on the flexible plastic sheet, and an overcoat varnish on the undercoat varnish, wherein the undercoat varnish and the overcoat varnish are configured to repel each other, so that the overcoat varnish is retracted into the shape of a drop.

2. The self-adhesive label according to claim 1, wherein the undercoat varnish and the overcoat varnish are immiscible varnishes.

3. The self-adhesive label according to claim 1, wherein the spreading coefficient of the liquid overcoat varnish on the polymerized undercoat varnish is a negative value.

4. The self-adhesive label according to claim 1, wherein the undercoat varnish and/or the overcoat varnish is polymerized under ultraviolet rays.

5. The self-adhesive label according to claim 1, wherein the undercoat varnish is formulated with surfactants on a polyurethane base.

6. The self-adhesive label according to claim 1, wherein the undercoat varnish includes silicone.

7. The self-adhesive label according to claim 1, wherein the overcoat varnish is formulated on an acrylic/polyurethane base.

8. The self-adhesive label according to claim 1, wherein the overcoat varnish is "silicone free", i.e., formulated without siliconized surfactant.

9. The self-adhesive label according to claim 1, wherein:

the flexible plastic sheet has a cut edge at a periphery of the flexible plastic sheet, one face of the flexible plastic sheet being entirely covered by the layer of adhesive; and an extra thickness comprising the undercoat varnish and the overcoat varnish is formed on a surface of the flexible plastic sheet opposite the layer of adhesive, the extra thickness having an uppermost first surface and a lowermost second surface in contact with the flexible plastic sheet, and being comprised of a flexible plastic material from the uppermost first surface to the lowermost second surface, the lowermost second surface of the extra thickness being in contact with and covering the upper second face of the flexible plastic sheet at the cut edge of the flexible plastic sheet, the extra thickness, from the uppermost first surface to the lowermost second surface, forming a decorative design simulating an engraved relief or an edge of a seal, the extra thickness having a cut edge extending from i) a periphery of the lowermost second surface of the extra thickness to ii) a periphery of the uppermost first surface of the extra thickness, wherein the cut edge at the periphery of the extra thickness and the cut edge at the periphery of the flexible plastic sheet are cut jointly, the cut edge at the periphery of the lowermost second surface of the extra thickness coinciding with the cut edge of the flexible plastic sheet as a continuation of the cut edge of the flexible plastic sheet up to the a lower surface of the flexible plastic sheet.

10. The self-adhesive label according to claim 1, wherein the layer of adhesive, the flexible plastic sheet the undercoat varnish and the overcoat varnish are, at least in part, transparent.

11. The self-adhesive label according to claim 1, wherein at least one of the varnishes comprises digital printing with a UV varnish.

12. The self-adhesive label according to claim 1, wherein the flexible plastic sheet bears a "resin stop" molding printed with an aqueous or UV varnish configured to repel at least one of the undercoat varnish and the overcoat varnish.

13. The self-adhesive label according to claim 1, wherein the flexible plastic sheet comprises metallized polyester.

14. The self-adhesive label according to claim 1, wherein the flexible plastic sheet is made of PVC, PP or transparent polyolefin.

15. The self-adhesive label according to claim 1, wherein the flexible plastic sheet carries printing of two screen-printed solid areas of matte ink, superimposed on each other forming a totally opaque color background.

16. A bottle made of glass bearing a label according to claim 1 glued on its surface, wherein the undercoat varnish and/or the overcoat varnish comprises pigments of the color of the glass of which the bottle is made.

17. A method of manufacturing a self-adhesive label produced in relief in order to visually and/or tactilely simulate a decorative molding of a material of a container or a decorative seal or stamp applied to the container, the method comprising:

a step of applying adhesive onto a first surface of a flexible plastic sheet, the flexible plastic sheet having a second surface opposite the first surface;

a step of applying, on the second surface of the flexible plastic sheet, an undercoat varnish; and a step of applying, on the undercoat varnish, an overcoat varnish, wherein the undercoat varnish and the overcoat varnish are configured to repel each other, so that the overcoat varnish is retracted into the shape of a drop.

18. The method according to claim 17, that further comprises a step of jointly cutting i) a periphery of the undercoat varnish, ii) a periphery of the overcoat varnish and iii) a periphery of the flexible plastic sheet to thereby form a cut edge in the extra thickness comprising the undercoat varnish and the overcoat varnish and in the flexible plastic sheet, so that the cut edge of the extra thickness is formed as a continuation of the cut edge of the flexible plastic sheet up to a lower surface of the flexible plastic sheet.

19. The method according to claim 17, that comprises:

a step of printing a molding with a side varnish configured to repel the undercoat varnish;

a step of half-cutting the shape of the label so as to cut only the thickness of the sheet and not that of the removable carrier;

a step during which undercoat varnish is poured outside the side varnish, the undercoat varnish stopping when it abuts the cut; and a step of hardening the undercoat varnish.

* * * * *